US006212901B1

(12) United States Patent
Pint et al.

(10) Patent No.: US 6,212,901 B1
(45) Date of Patent: Apr. 10, 2001

(54) DRY ICE COOLER

(76) Inventors: Kenneth R. Pint, P.O. Box 488, Jasper, GA (US) 30143; William F. Thom, 17 Laurelwood La., Blue Ridge, GA (US) 30513

( * ) Notice: Subject to any disclaimer, the term of this patent is extended or adjusted under 35 U.S.C. 154(b) by 0 days.

(21) Appl. No.: 09/344,908

(22) Filed: Jun. 26, 1999

(51) Int. Cl.[7] ..... F25D 3/08
(52) U.S. Cl. ..... 62/457.7; 62/370; 62/265
(58) Field of Search ..... 62/457.7, 370, 62/265

(56) References Cited

U.S. PATENT DOCUMENTS 537,193 * 4/1895 Goetz ..... 62/265
634,791 * 10/1899 Bachner ..... 62/265
916,282 * 3/1909 Dunkle ..... 62/265
1,744,890 * 1/1930 Hanrahan ..... 62/265
3,807,194 * 4/1974 Bond ..... 62/457
4,537,044 * 8/1985 Putnam ..... 62/371
4,561,262 * 12/1985 Fredrixon ..... 62/62
5,216,900 * 6/1993 Jones ..... 62/457.2

* cited by examiner

*Primary Examiner*—William Doerrler

(57) ABSTRACT

A cooler with a chamber and a cavity in its lid, into which cavity a block of dry ice is inserted. Heat transfers from the chamber through a heat transfer element connecting the chamber to the cavity. The rate of this heat transfer is regulated by covering or uncovering the heat transfer element on the chamber side.

7 Claims, 4 Drawing Sheets

DRY ICE COOLER

FIELD OF THE INVENTION

Coolers, that is, containers that maintain a lower temperature than the surrounding atmosphere.

BACKGROUND OF THE INVENTION

The earliest cooler may have been a shaded basket. Since then dramatic improvements have been made to the design. These improvements stem from three basic technological advances: Availability of insulating materials, better manufacturing, and the ability to pump heat from liquids or gases which are then used to keep the inside of the container cool.

Insulating materials that are available all reduce heat transfer between their sides, and are built to suit their intended uses. These materials include walls separated by vacuum (to prevent convection) or a solid foam or simply by air. They likewise may include reflective surfaces (to reflect radiated heat).

Construction advances allow the insulating material to fit seamlessly to become a container. Construction also makes coolers practical in a wide variety of uses, despite the relative fragility of insulating materials, because the insulating material is housed in excellent casings.

Cold materials, including most commonly ice, are then put into the cooler to maintain the lower temperature. The cold material will be at a lower temperature than the atmosphere surrounding the cooler. When heat gets through the insulating material into the cooler, raising its temperature, the cold material absorbs that heat. The cooler will therefore reach a stable temperature lying between that of the outside atmosphere and that of the cold material. Where exactly the temperature lies in that range depends on several factors including contents of the cooler, efficacy of the insulating material, and surface areas.

The most effective cold materials are not only cold, but have had the latent heat of a state change extracted from them. For example, to become ice the latent heat of freezing is extracted from water. Thus, the best cold materials change state as they absorb heat Most often this means that they melt, but they may also liquify or even sublimate.

This is only one major problem with ice. It turns back to water, which floods the cooler, and makes it difficult for the remaining ice to keep the cooler cold. The second major problem with ice is that it is not cold enough. That is, because it changes state at 0° Celsius (32° Fahrenheit), this (and only rarely lower) is the temperature that it draws the cooler toward. As explained above, the cooler generally does not reach the temperature of the cold material; and thus, when cooled by ice, the cooler will not keep frozen foods frozen.

The problem that ice turns to water (spillage) has been inadequately solved several ways, including holding the ice within its own container, which reduces its surface area and cooling properties. The relative warmth of ice's freezing point has not been solved.

Colder materials, that is, materials that change state at lower temperatures, obviously will hold the cooler colder. For example, dry ice sublimates at −77.2° Celsius (−107° Fahrenheit). This takes care of any problems with messy melted dry ice spillage but produces $CO_2$, which is corrosive.

Another problem with dry ice is too much cooling ability. It can drop temperatures below freezing, as follows from the explanation above, which might be colder than desired. A related problem is its uneven cooling; that is, as a block of dry ice, such as that produced by U.S. Pat. No. 5,528,907, which is incorporated by reference for its information on the properties of $CO_2$, shrinks, its cooling ability drops.

What is needed is a way to control the rate of heat transfer to a block of dry ice, and to use such a block in a cooler in a commercial and practical manner, which allows the cooler to hold a temperature below or above freezing, as desired by its owner. This allows a cooler with separate chambers for frozen and not frozen foods, that is, to perform like a fridge.

SUMMARY OF THE INVENTION

A cooling assembly being a structure into which a cold material is inserted in contact with a transfer element through which heat transfers, which heat transfer is adjusted by covering the transfer element more or less.

BRIEF DESCRIPTION OF THE DRAWINGS

Preferred embodiments of the apparatus of this invention will be described in detail below in connection with the following drawings, in which like numbers refer to like components.

DETAILED DESCRIPTION OF PREFERRED EMBODIMENTS

Figure 1:
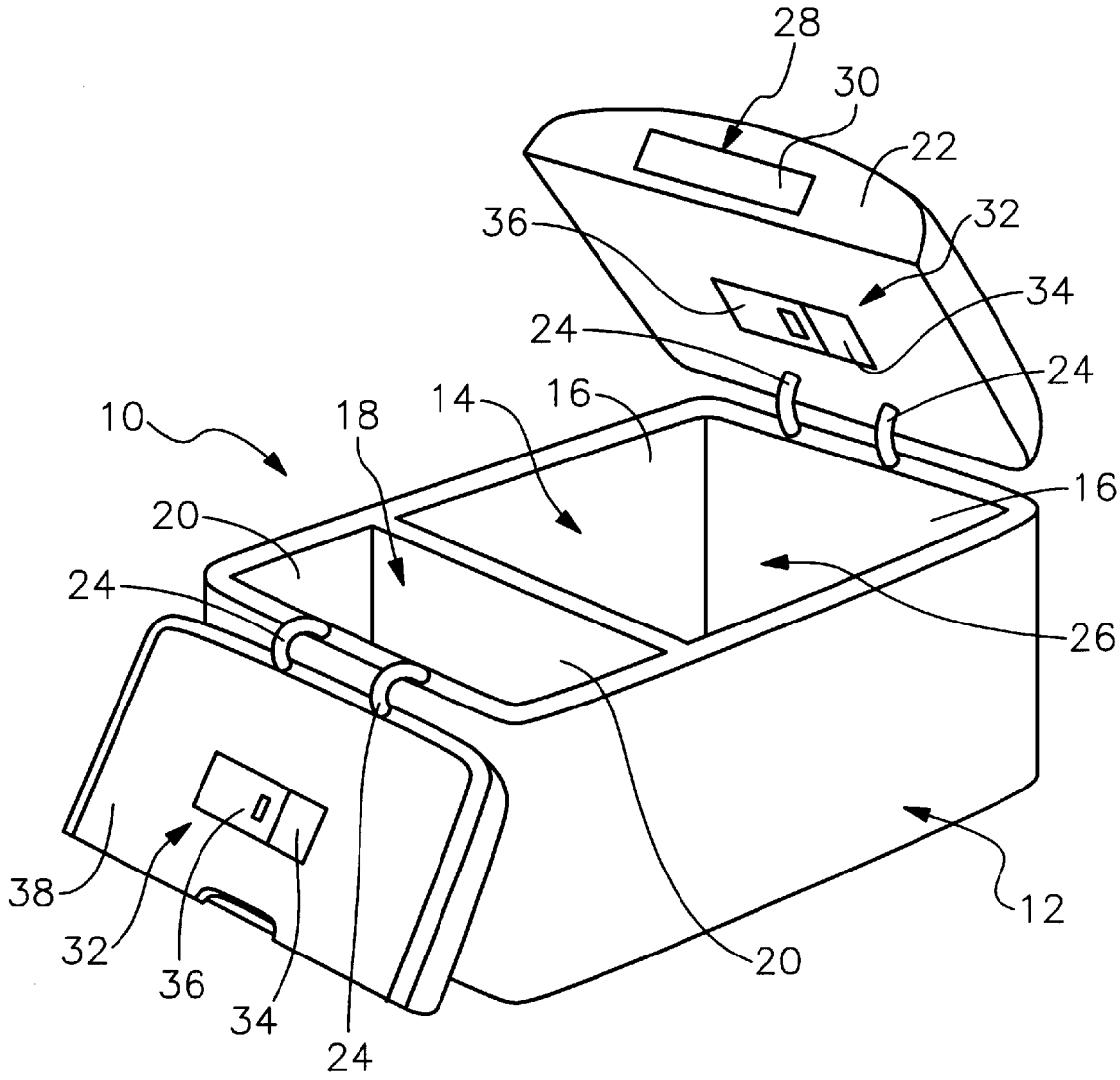
FIG. 1 is an orthogonal view of a cooler incorporating features of the present invention.

The present invention is preferably incorporated into a cooler, generally referred to in FIG. 1 as 10. A typical cooler 10 which is available from a variety of sources has an outer insulating wall, generally referred to as 12, and a chamber, generally referred to as 14, inside these walls. This chamber 14 is preferably suitable to have water ice poured in to it, that is, its inner walls 16 are preferably waterproof.

In this preferred embodiment the cooler 10 has a second chamber, generally referred to as 18, adapted to use at colder temperatures than chamber 14. It is practical that the walls 20 of chamber 18 be likewise waterproof. Although a cooler 10 with two chambers, is shown in FIG. 1, the present invention is equally suited to single or more than two chambered coolers, and can likewise be used in other situations where convenient, adjustable cooling is required, including soft pouches that need cooling, hard-to-reach places in aircraft, ships, spaceships, electronics and computers, and other applications.

In this two-chambered preferred embodiment, a larger lid 22 is attached by hinges 24 to the walls 12 of the cooler 10. This lid 22 closes over the opening, generally referred to as 26, on top of the chamber 14 and insulates and seals that chamber 14 from the surrounding atmosphere.

The lid 22 has an opening or cavity, generally referred to as 28, preferably through its side, although opening 28 can be through any side of any structure incorporating the cooling assembly being described. This opening 28 has a preferably insulated cover 30, which is designed to fit snugly inside the opening 28.

A cold material such as a dry ice block created following U.S. Pat. No. 5,528,907, which is incorporated by reference, is inserted through insertion opening 28 and serves to draw heat from the chamber 14 through an opening, generally referred to as 32. In this preferred embodiment this heat transfer passes through a plate 34. This plate 34 may be a 1/16 inch thick plate of aluminum, or other material determined through tests and calculations to have heat transmission properties desired for the application to which a cooling assembly is being suited. Plate 34 need not be a plate, but can be any element that has heat transmission properties desired; or plate 34 might simply be omitted.

In this preferred embodiment using a plate 34, the material and thickness of the plate 34 may be estimated using the formula:

$$\text{Heat Flow} = K\frac{(t_1 - t_2)}{\text{Thickness}},$$

where K is a constant for the material (for example, 237 for aluminum), $t_1$ is the higher temperature, $t_2$ is the lower temperature, and thickness is the thickness of the material through which heat is flowing.

Once a material for plate 34 is chosen, the actual heat flow through plate 34 from its exterior surface to its cavity surface may preferably be regulated by adjustable sliding cover 36 adjacent the exterior surface to cover, partially uncover, or completely uncover the plate 34. Cover 36 travels between an open position substantially uncovering the exterior surface and a closed position in which the exterior surface is at least partially covered by the adjustable cover. Cover 36 is preferably made of insulating material that serves to better prevent heat transfer through it and therefore through the underlying plate 34.

A two chamber cooler 10 will preferably have a second lid 38, which again preferably matches the size of the chamber 18 that it closes.

Figure 2:
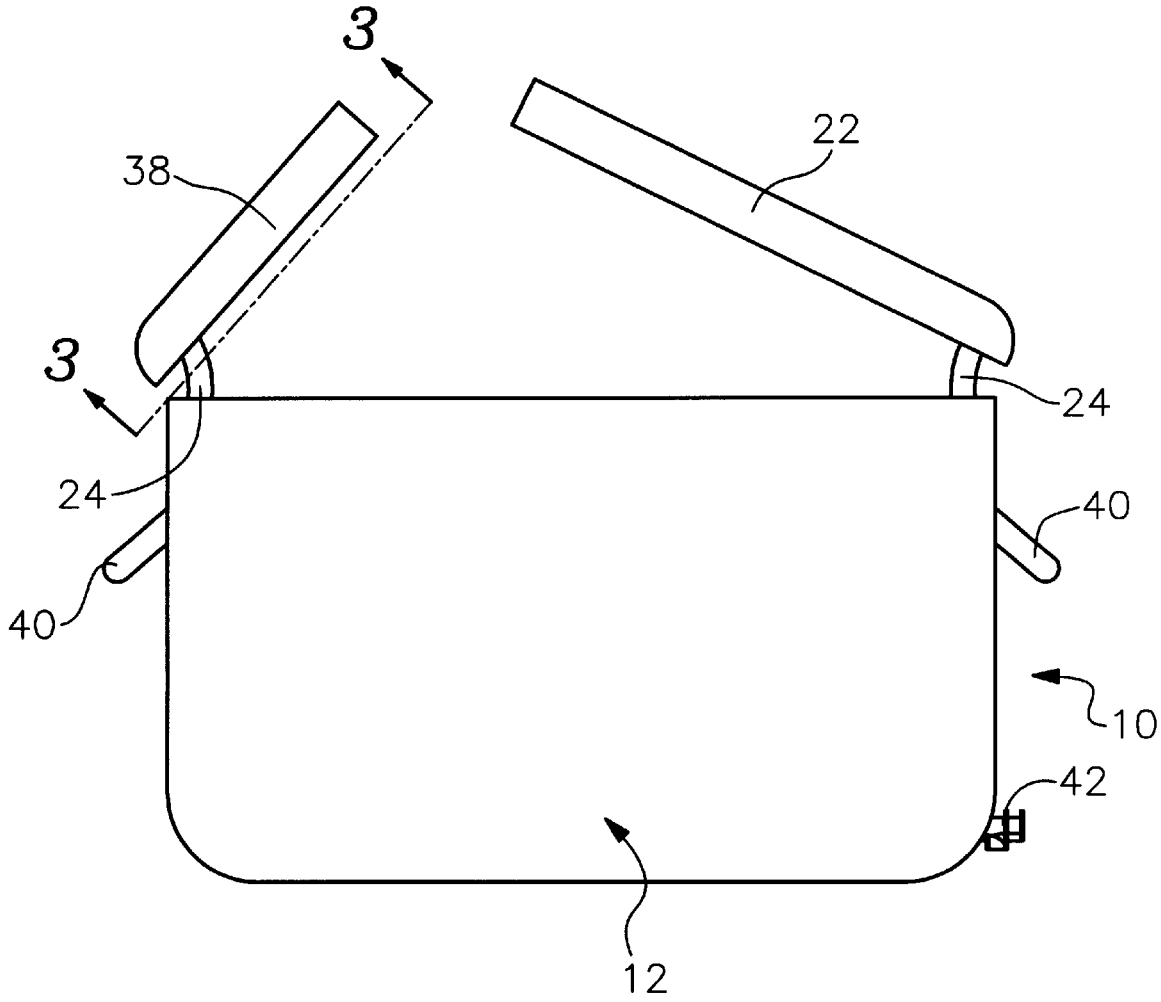
FIG. 2 is a side elevation of the cooler of FIG. 1.

FIG. 2 is a side view of the cooler 10 of FIG. 1. Commercial coolers 10 commonly have handles 40 for the convenience of their owners. Also, if the cooler 10 is designed to also accept water ice, in combination with other cold materials such as dry ice or alone, then it is convenient to have a pour spout 42 toward the bottom of the cooler 10 for pouring out the inevitable water.

Figure 3:
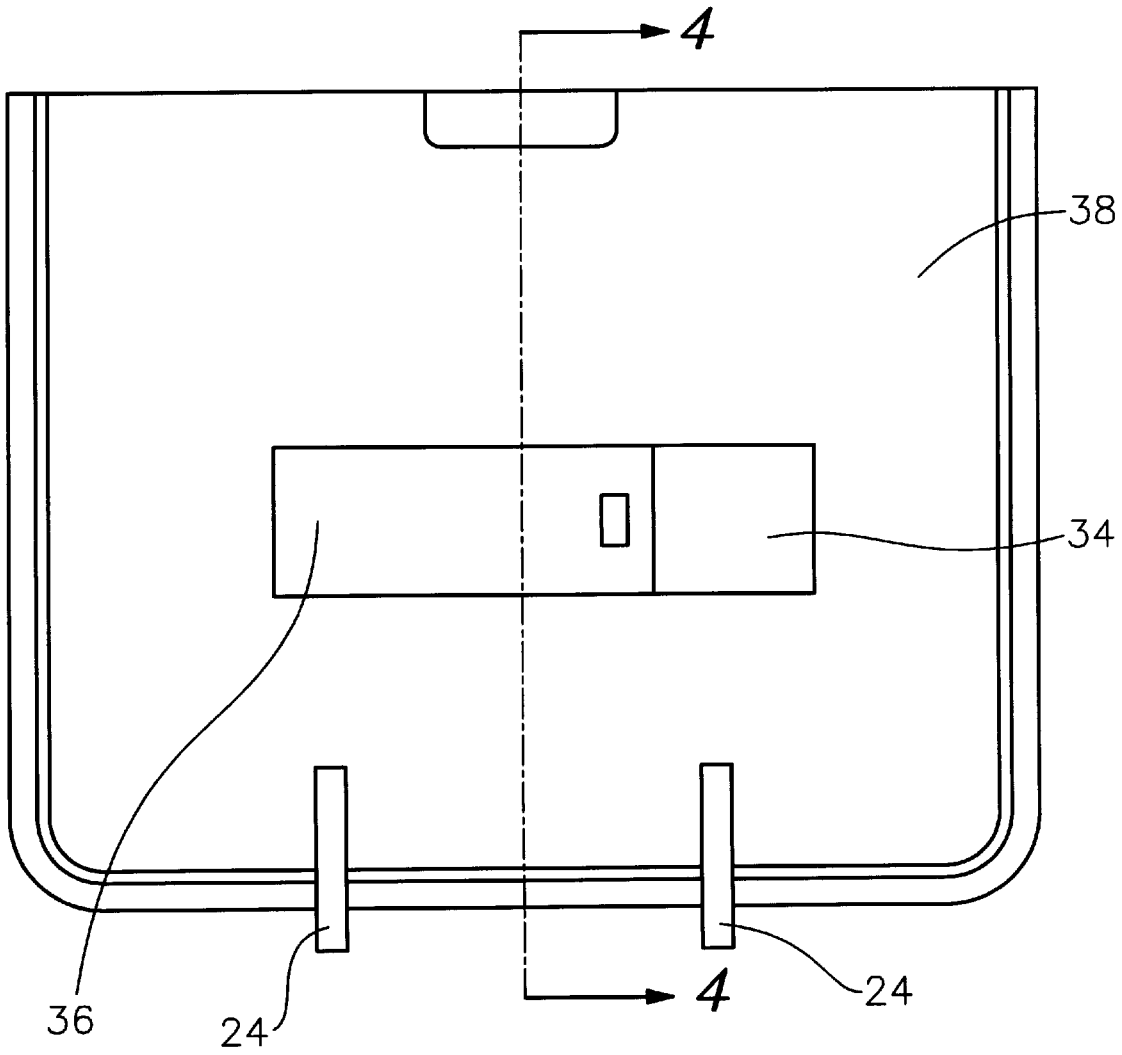
FIG. 3 is a bottom elevation of a lid of the cooler of FIG. 2, taken along line 3—3 of FIG. 2, showing an example of the heat transfer control feature of the present invention.
Figure 4:
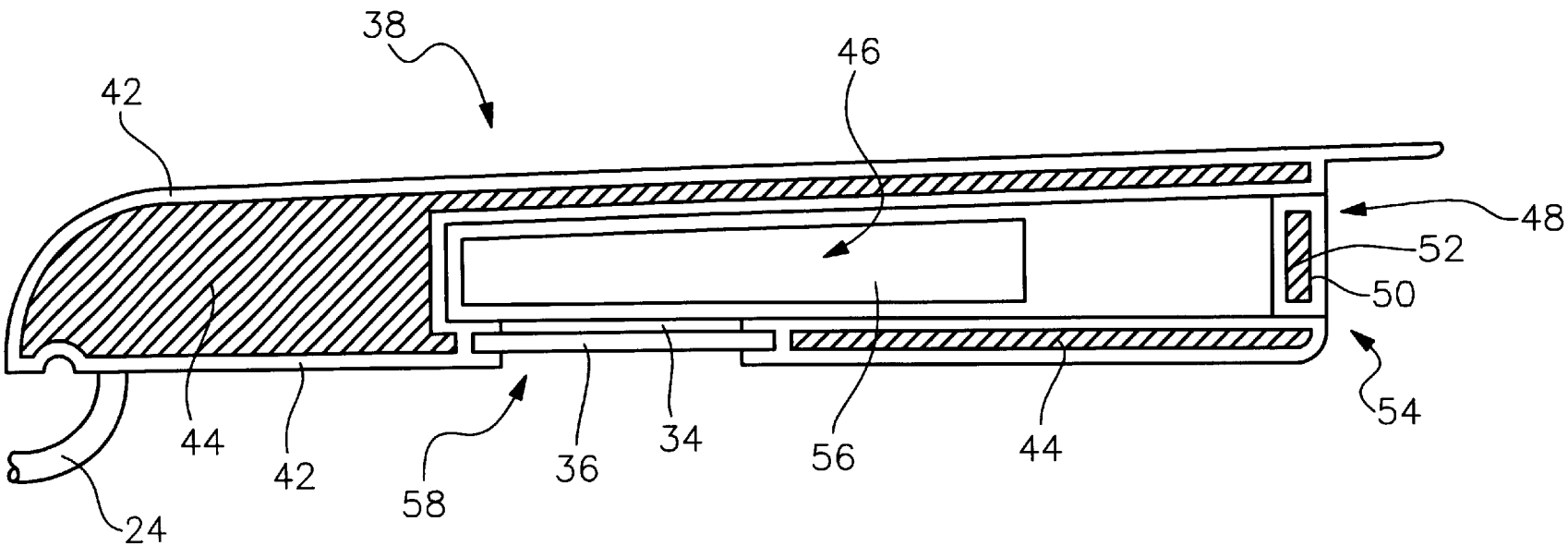
FIG. 4 is a sectional view taken along line 4—4 of FIG. 3, showing a cavity in the lid shown in FIG. 3, into which cooling material is inserted, including a cover and a controlled heat transfer assembly.

FIG. 3 is a bottom view of the lid 38 taken along line 3—3 of FIG. 2. FIG. 4 is a sectional view of the lid 38 taken along line 4—4 of FIG. 3, and shows details of the construction of a preferred embodiment of a cooler assembly. In this embodiment the lid 38 is built using a shell 42 of a casing material such as hard plastic, steel, or the like. This shell 42 surrounds, contains, and protects a filling or layer of insulating material 44 such as foam, air, foamed fiberglass, steel, aluminum, or even a vacuum.

A cavity, generally referred to as 46, is opened into the lid 38, into which the cold material is inserted, followed by a cover or lid, generally referred to as 48. Cover 48 is made of an outside shell 50 or casing 50 for which the above materials may be used surrounding an insulating layer 52 or filler 52 selected from the materials likewise listed above. This cover 48 is preferably designed to fit the opening, generally referred to as 54, of the cavity in the lid 38 snugly to prevent heat transfer into the cold material 56 that is not mediated and regulated by the plate 34 and cover 36, which themselves block a second opening, generally referred to as 58, into the cavity 46.

The cooling assembly is shown in the lid of a cooler. Because of uneven cooling and convection, and well as limiting contact of cooled materials with the plate 34, thereby excessively cooling the materials in contact with the plate, this is the preferred placement. Those skilled in the art will know to implement equally suitable placements, which may require grilles to distance the cooled materials from the plate 34, or may require ventilation shafts or even passive or active valve systems.

What is claimed is:

1. A cooling assembly comprising:

a structure having a cavity therein, said cavity having an insertion opening through said structure for insertion of a cold material and a transfer opening through said structure for transfer of heat into said cavity;

a transfer element substantially blocking said transfer opening, having a cavity surface adjacent said cavity and an exterior surface substantially opposite to said cavity surface, such that said cold material will contact said transfer surface substantially on said cavity surface;

an adjustable cover over said transfer surface for adjusting between an open position substantially uncovering said exterior surface and a closed position in which said exterior surface is at least partially covered by said adjustable cover, said adjustable cover then being adjacent said exterior surface when in said closed position, whereby a rate of heat transfer into said cavity is regulated; and an active ventilation valve for ventilation of said cold material or said transfer opening, whereby said rate of heat transfer is further regulated.

2. The cooling assembly of claim 1 wherein said adjustable cover slides adjacent said exterior surface between said open position and said closed position along at least one guide in said structure.

3. The cooling assembly of claim 1 further comprising a lid for substantially closing said insertion opening.

4. The cooling assembly of claim 1 wherein said cold material is a block of dry ice, whereby heat transfer is faster than water ice and sublimation prevents spillage.

5. The cooling assembly of claim 1 wherein said transfer element comprises an aluminum plate.

6. A cooler comprising:

at least one chamber substantially surrounded on all but an open side by insulated walls;

at least one insulated lid openably engaging said open side, said insulated lid travelling between an open position allowing access to said chamber and a closed position preventing said access, said lid having a cavity therein, said cavity having an insertion opening through said lid for insertion of a cold material and a transfer opening through said lid for transfer of heat into said cavity;

a transfer element substantially blocking said transfer opening, having a cavity surface adjacent said cavity and an exterior surface substantially opposite said cavity surface, such that said inserted cold material will contact said transfer surface substantially on said cavity surface;

an adjustable cover over said transfer surface for adjusting between an open position substantially uncovering said exterior surface and a closed position in which said exterior surface is at least partially covered by said adjustable cover, said adjustable cover then being adjacent said exterior surface when in said closed position, whereby a rate of heat transfer into said cavity is regulated; and an active ventilation valve for ventilation of said cold material or said transfer opening, whereby said rate of heat transfer is further regulated.

7. The cooler of claim 6 wherein said cooler has an upward direction during normal use, and wherein said lid is substantially upward of said chamber.

* * * * *